United States Patent [19]

Kinoshita

[11] 4,299,257

[45] Nov. 10, 1981

[54] SELVAGE FORMING DEVICE

[75] Inventor: Shinichi Kinoshita, Neagari, Japan

[73] Assignee: Tsudakoma Kogyo Kabushiki Kaisha, Japan

[21] Appl. No.: 36,431

[22] Filed: May 7, 1979

[30] Foreign Application Priority Data

May 19, 1978 [JP] Japan ..... 53/60320
Jun. 23, 1978 [JP] Japan ..... 53/76821

[51] Int. Cl.[3] ..... D03D 5/00; D03D 47/40
[52] U.S. Cl. ..... 139/54
[58] Field of Search ..... 139/54, 430

[56] References Cited

U.S. PATENT DOCUMENTS

| | | | |
|---|---|---|---|
| 3,191,634 | 6/1965 | Hall | 139/54 |
| 3,227,191 | 1/1966 | Juillard | 139/54 |
| 3,871,414 | 3/1975 | Palencher | 139/54 |
| 3,952,778 | 4/1976 | Volpe | 139/54 |
| 4,066,105 | 1/1978 | Heinrich et al. | 139/54 |

FOREIGN PATENT DOCUMENTS

| | | | |
|---|---|---|---|
| 2306289 | 10/1976 | France | 139/54 |

*Primary Examiner*—Henry Jaudon
*Attorney, Agent, or Firm*—Ostrolenk, Faber, Gerb & Soffen

[57] ABSTRACT

A selvage forming device is provided with cooperating thread distributing elements which perform relative vertical movements to each other over prescribed distances while utilizing shedding motion of harnesses for plain weave only in order to distribute at least one leno warp for one course of leno weave alternately onto different lateral sides of each ground warp controlled by a guide needle once in every pick by means of sliding contact of their slat edges with the leno warp, thereby forming stout leno selvages for woven cloths with simplified construction and movements of the related mechanical elements.

22 Claims, 50 Drawing Figures

Fig. 1
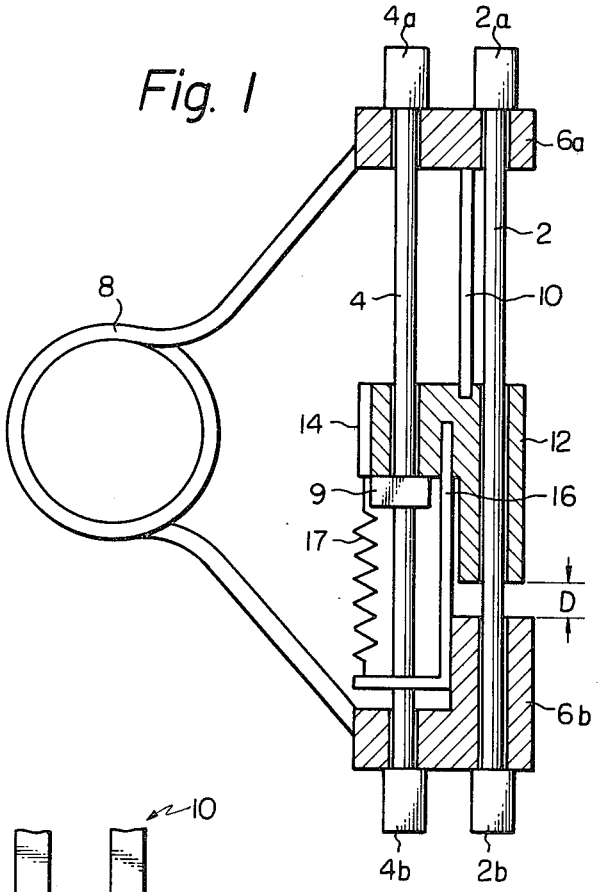
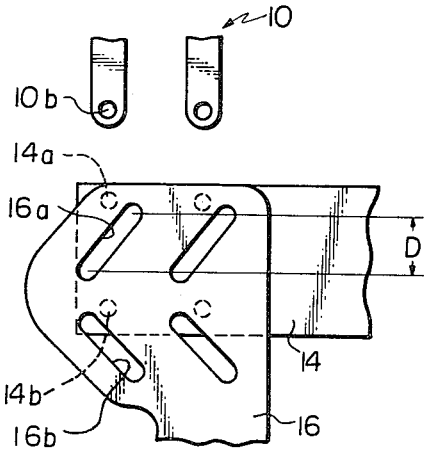
Fig. 3

Fig. 14
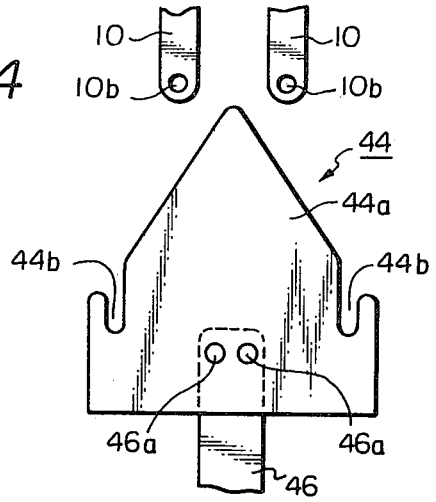
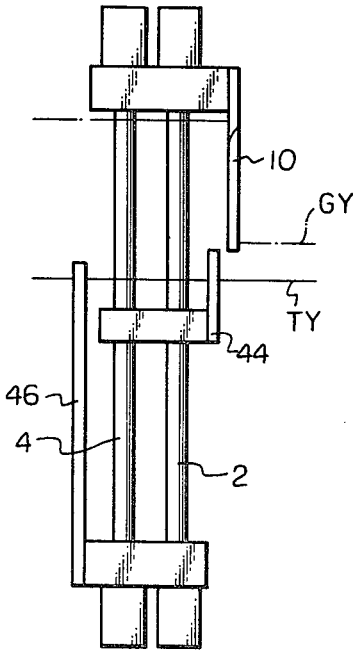
Fig. 15A

SELVAGE FORMING DEVICE

BACKGROUND OF THE INVENTION

The present invention relates to an improved selvage forming device, and more particularly relates to improvement in construction of a device for forming selvages of woven cloths by twisting leno warps with ground warps.

Twisted weave is classified into gauze and leno weaves and made up of twisting warps, ground warps and wefts. In the case of leno weave, twisted warps, i.e. leno warps, are always located on wefts. The present invention contemplates improvement in formation of selvages for woven cloths utilizing the art of leno weave.

In formation of a course of leno weave, one or more leno warps have to be alternately distributed onto different lateral sides of a ground warp once per prescribed number of picks so that the leno warps twist around the ground warp. Although various devices have been conventionally proposed to carry out this distribution of leno warps, they are almost all accompanied by at least one of the following drawbacks.

(i) In order to form sufficiently stout selvages, it is necessary to enlarge and complicate the construction of the device.

(ii) A lot of movable elements are required to carry out very intricate movements, thereby causing increased mulfunctions and shortening the life of the device.

(iii) Since the leno warps contact the thread guide elements at limited sections of the latter, sharp depressions are formed in the contact sections of the thread guide elements, which tend to cause frequent yarn breakages and generation of fluffs on the leno warps. In order to avoid such troubles, frequent replacement of such thread guide elements is required which apparently leads to disadvantage in economy and increased labour.

(iv) Due to intricate movements of the related mechanical elements, the device is unable to well follow high speed running of weaving looms. It is also difficult to have increased courses of leno weaves in a single selvage construction.

(v) Due to intricacy in construction, a lot of mechanical elements are neither visible nor accessible from outside of the device. This often leads to delayed detection of abnormal operations and difficulty in maintenance.

(vi) Leno warps are subjected to large bending at distribution, thereby causing undesirable damages on the leno warps and degradation of woven cloths produced.

SUMMARY OF THE INVENTION

It is the primary object of the present invention to provide a selvage forming device capable of forming stout selvages despite its compact construction.

It is another object of the present invention to provide a selvage forming device provided with greatly reduced number of movable elements which are very simple in movement, and longer in life.

It is the other object of the present invention to provide a selvage forming device which is free of formation of sharp depressions on thread guide elements by abrasive contact with leno warps, thereby successfully minimizing yarn breakages and fluff generation without need for frequent replacement of such elements.

It is a further object of the present invention to provide a selvage forming device capable of well following high speed running of weaving looms and easily increasing the number of course of leno for a single selvage construction.

It is a yet further object of the present invention to provide a selvage forming device adapted for easy observation and access from outside of the device, thereby enabling early detection of abnormal operations and easy maintenance.

It is a yet further object of the present invention to provide a selvage forming device which does not force large bending to leno warps at the distribution, thereby greatly reducing damage on leno warps and enhancing the quality of the produced woven cloths.

In accordance with the basic concept of the present invention, firstly, distribution of the leno warps is carried out by the MAV system, in which alternate distribution of the leno warps is carried out once in every pick. Secondly, related mechanical elements are required to perform simple vertical movements only while utilizing shedding motion of heald frame for plain weave or like lever motion. Thirdly, displacement of the leno warps is carried out by means of sliding contact of slant edges of the related elements. Fourthly, the leno warps undergo minimum but necessary bending only during the alternate distribution.

BRIEF DESCRIPTION OF THE DRAWINGS

FIG. 1 is a side view, partly in section, of the first embodiment of the selvage forming device in accordance with the present invention, FIG. 3 is an explanatory front view of the thread distributing mechanism of the device shown in FIG. 1, FIGS. 4A to 4G are side views for showing operation of the device shown in FIG. 1, FIGS. 5A to 5E are simplified front views for showing operation of the thread distributing mechanism shown in FIG. 3, FIGS. 6A to 6G are explanatory plan views for showing thread distribution of the device shown in FIG. 1, FIG. 14 is an explanatory front view of the thread distributing mechanism of the device shown in FIG. 12, FIGS. 15A to 15C are side views for showing operation of the device shown in FIG. 12, FIGS. 16A to 16C are explanatory front views for showing operation of the thread distributing mechanism shown in FIG. 14, FIGS. 17A to 17C are explanatory plan views for showing thread distribution on the device shown in FIG. 12.

DESCRIPTION OF THE PREFERRED EMBODIMENTS

In the following description, elements of the selvage forming device in accordance with the present invention are referred to in a state mounted to the loom. Consequently, the word "front" or "forwards" refers to positions closer to the woven cloth, whereas the word "back" or "rearwards" refers to positions closer to the warp beam.

Figure 2:
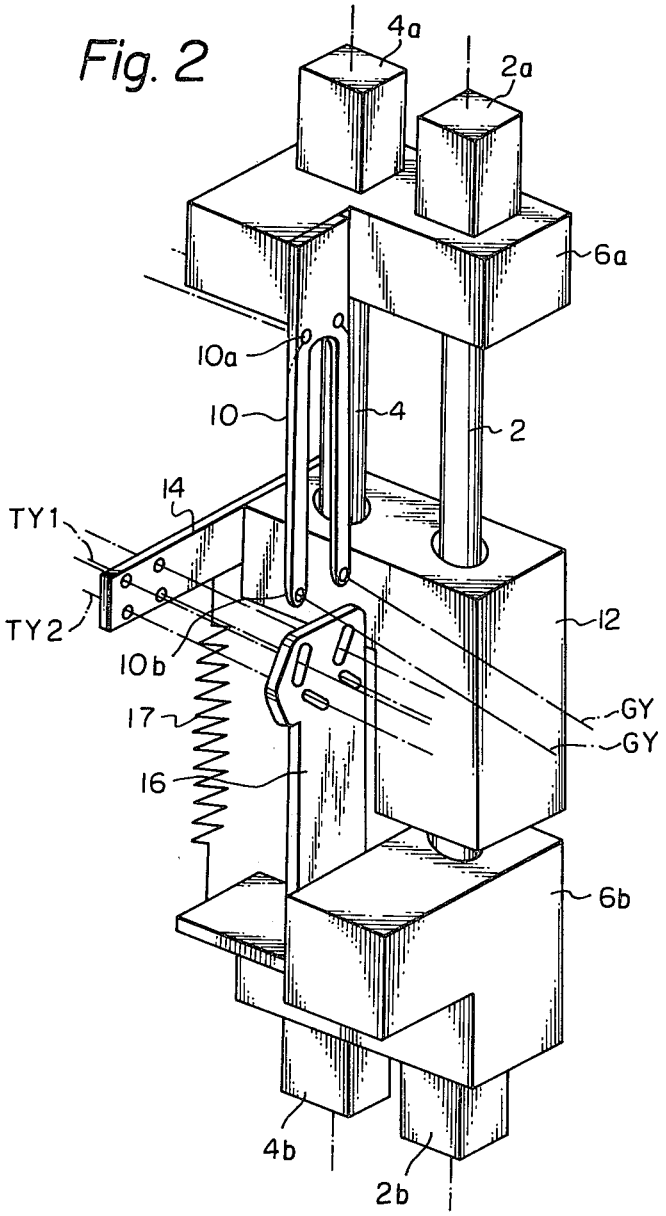
FIG. 2 is a perspective view of the device shown in FIG. 1.

The first embodiment of the present invention is shown in FIGS. 1 to 3. A pair of substantially vertically extending front and back rods 2 and 4 are arranged in parallel to and properly spaced from each other. The front rod 2 is provided, at both ends, with enlarged upper and lower end pieces 2*a* and 2*b*. Likewise, the back rod 4 is provided, at both ends, with enlarged upper and lower end pieces 4*a* and 4*b*. By means of these end pieces 2*a*, 2*b* and 4*a*, 4*b*, the rods 2 and 4 are linked to associated heald frames (not shown) for plain weave, respectively so that each moves vertically as the associated heald frame moves vertically.

Beneath the upper end pieces 2*a* and 4*a*, a guide needle holder 6*a* is idlly inserted over the rods 2 and 4. This holder 6*a* will hereinafter be referred to simply as "an upper holder". On the lower end pieces 2*b* and 4*b*, a distributing guide holder 6*b* is idlly inserted over the rods 2 and 4 also. This holder 6*b* will hereinafter be referred to simply as "a lower holder". A torsion spring 8 is coupled, at both ends, to the back side faces of the upper and lower holders 6*a* and 6*b* so that the upper holder 6*a* is always urged on resilient pressure contact with the upper end pieces 2*a* and 4*a* whereas the lower holder 6*b* is always urged on resilient pressure contact with the lower end pieces 2*b* and 4*b*.

A fork-type guide needle 10 is fixed, at the top end, to the front side face of the upper holder 6*a* and extends downwards. As later described in more detail, the guide needle 10 has two branches spaced laterally from each other, each having a pair of upper and lower thread guide holes.

A stopper 9 is fixed about the middle of the back rod 4 and a guide plate holder 12 is idlly inserted over the rods 2 and 4 with its rear extension resting on the stopper 9. This guide plate holder 12 will hereinafter be referred to simply as "an intermediate holder". A guide plate 14 is fixed to the back side face of the intermediate holder 12 while projecting laterally.

A distributing guide 16 is fixed, at the lower end portion, to the back side face of the lower holder 6*b* and extends upwards. The upper end of the distributing guide 16 is located, in the illustrated state, near the lower end of the guide needle 10.

In the state shown in FIG. 1, the shed is closed and this state will hereinafter referred to as "the neutral state". In accordance with the basic concept of the present invention, a prescribed gap D should be left between the uppermost end face of the lower holder 6*b* and the lowermost end face of the intermediate holder 12 when the device is in the neutral state. A tension spring 17 is interposed between the lower end of the guide plate 14 and the lower bent arm of the distributing guide 16.

Relation in position between the three thread guide elements, i.e. the guide needle 10, the distributing guide 16 and the guide plate 14, in the neutral state is shown in detail in FIG. 3. The guide needle 10 is located on the front side of the distributing guide 16 whereas the guide plate 14 is located on the back side of the distributing guide 16.

In the case of the illustrated embodiment, two pairs of upper and lower thread guide holes 14*a* and 14*b* are formed through the guide plate 14, one pair being for one course of leno. The guide holes 14*a* and 14*b* are located on a vertical line on which the lower thread guide hole 10*b* of the guide needle 10 is located also. As later described in more detail, the guide needle 10 is adapted for guiding ground warp GY. Therefore, a vertical plane extending in the warp direction and including the above-described common vertical line will hereinafter be referred to as "a ground warp plane GYP".

A pair of upper and lower thread guide slots 16*a* and 16*b* are formed through the distributing guide 16 for one course of leno. When seen from the front side of the device, the upper guide slot 16*a* starts at a position on the inner side of the ground warp plane GYP and slopes downwards and outwardly of the ground warp plane GYP. The lower guide slot 16*b* starts at a position on the inner side of the ground warp plane GYP and slopes upwards and outwardly of the ground warp plane GYP. In the illustrated state, the thread guide holes 14*a* and 14*b* of the guide plate 14 are located under the lower thread guide 10*b* of the guide needle 10, the upper end of the upper thread guide slot 16*a* of the distributing guide 16 is located about the level of the upper thread guide hole 14*a* of the guide plate 14, and the upper end of the lower thread guide slot 16*b* of the distributing guide 16 is located about the lower thread guide hole 14*b* of the guide plate 14. The vertical distance between both ends of each guide slot 16*a* and 16*b* is equal to the vertical length of the gap D.

Operation of the above-described device will hereinafter be explained in more detail, reference being made to FIGS. 4A to 4G. It is assumed that the ground warp GY from the warp beam (not shown) runs in the warp direction via the upper guide hole 10*a* and the lower guide hole 10*b* of the guide needle 10. Further, it is assumed that one leno warp TY1 runs in the same direction via the upper guide hole 14*a* of the guide plate 14 and the upper guide slot 16*a* of the distribution guide 16, whereas the other leno warp TY2 runs in the same direction via the lower guide hole 14*b* of the guide plate 14 and the lower guide slot 16*b* of the distribution guide 16.

As already described, the front and back rods 2 and 4 are operationally coupled to the heald frames for plain weave via the end pieces 2*a*, 2*b*, 4*a* and 4*b*, respectively. Therefore, when one rod moves upwards or downwards over a certain distance, the other rod concurrently moves downwards or upwards over same distance.

Figure 4A:
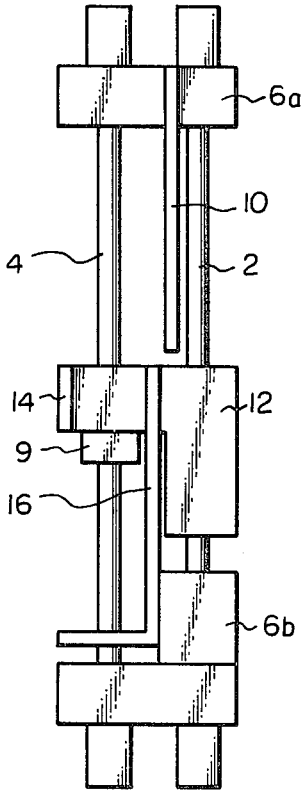

In FIG. 4A, the device is in the neutral state and the rods 2 and 4 are in the neutral position. As the front rod 2 starts to move upwards from the neutral position, the back rod 4 accordingly starts to move downwards from the neutral position. As a consequence, the stopper 9 fixed to the back rod 4 moves downwards and the guide plate 14 moves downwards since same is fixed to the intermediate holder 12 which is idlly inserted over the rods 2 and 4 and urged on downward movement by the tension spring 17. Concurrently with this procedure, the front rod 2 moves upwards, the lower holder 6*b* is thrusted upwards by the lower piece 2*b* fixed to the front rod, and the distributing guide 16 moves upwards also.

Figure 4B:
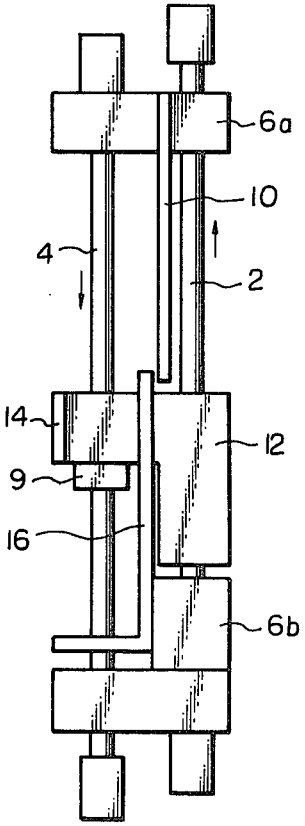

Thus, the guide plate 14 and the distributing guide 16 carry out a relative movement in which the former moves downwards and the latter moves upwards. In accordance with a basic concept of the present invention, the above-described relative movement between the two elements 14 and 16 is used for distributing the leno warps TY1 and TY2 on both lateral sides of the ground warp GY. For the purpose of simplity, this relative movement will hereinafter be referred to as "the first relative movement". The state of the device at a moment in the first relative movement is shown in FIG. 4B.

The distance of the gap D between the intermediate and lower holders 12 and 6*b* is equal to D in the neutral state. Therefore, the two elements 12 and 6*b* come in contact with each other after the intermediate holder 12 holding the guide plate 14 has moved downwards over a distance equal to D/2 and the lower holder 6*b* holding the distributing guide 16 has moved upwards over a distance equal to D/2. That is, the distance of the first relative movement is equal to D. In the state shown in FIG. 4C, the first relative movement has just been completed.

The first relative movement terminates as the holders 12 and 6*b* contact with each other. After this termination of the first relative movement, the intermediate holder 12 is thrusted upwards by the lower holder 6*b* and they move together upwards. Consequently, the guide plate 14 and the distributing guide 16 move upwards while keeping the relative vertical position shown in FIG. 4*c*. Following the downward movement of the back rod 4, the upper holder 6*a* is thrusted downwards by the upper end piece 4*a* fixed to the back rod 4 and the guide needle 10 fixed to the upper holder 6*a* moves downwards over a same distance.

Figure 4C:
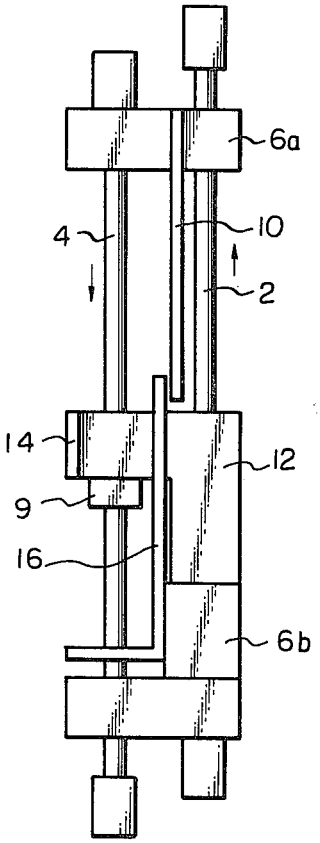
Figure 4D:
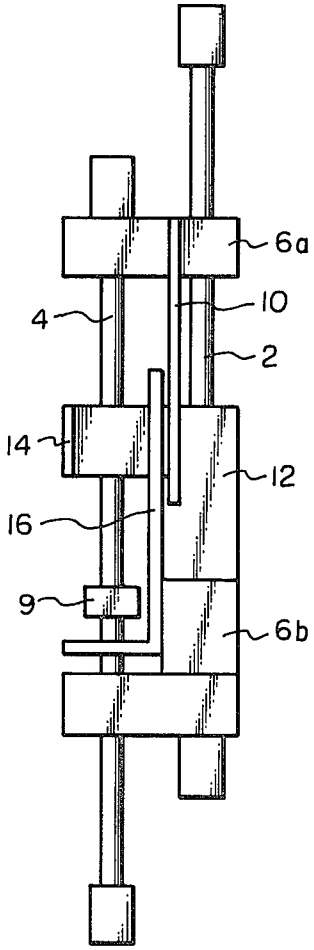

As the above-described vertical movements continue, the device assumes the state shown in FIG. 4D. In this state, the ground warp GY controlled by the guide needle 10 is located in the lower sheet of the open shed whereas the leno warps TY1 and TY2 controlled by the guide plate 14 and the distributing guide 16 are located in the upper sheet of the open shed. Therefore, an inserted weft W is located over the ground warp GY and under the leno warps TY1 and TY2.

The above-described vertical movements of the various members are summerized in Table 1.

TABLE 1

| | | |
|---|---|---|
| Front rod 2 | upward movement | |
| Back rod 2 | downward movement | |
| Guide needle 10 | downward movement | |
| Distributing guide 16 | upward movement | |
| Guide plate 14 | downward movement FIG. 4A → 4C the first relative movement | upward movement FIG. 4C → 4D |

As the weft insertion terminates, the next cycle of movements of the device start, the front rod 2 starts to move downwards and the back rod 4 starts to move upwards from the positions shown in FIG. 4D, respectively. Following the downward movement of the front rod 2, the lower holder 6*b* moves downwards with the lower end piece 2*b* while being urged by the torsion spring 8. The distributing guide 16 fixed to the lower holder 6*b* accordingly moves downwards. Since the intermediate holder 12 is pulled toward the lower holder 6*b* by means of the tension spring 17, the intermediate holder 12 and the guide plate 14 both follow this downward movement. Thus, the vertical position between the elements 14 and 16 shown in FIG. 4D is kept at this stage of the procedure. It should be noted that this relative vertical position is similar to that in the state shown in FIG. 4C.

Figure 4E:
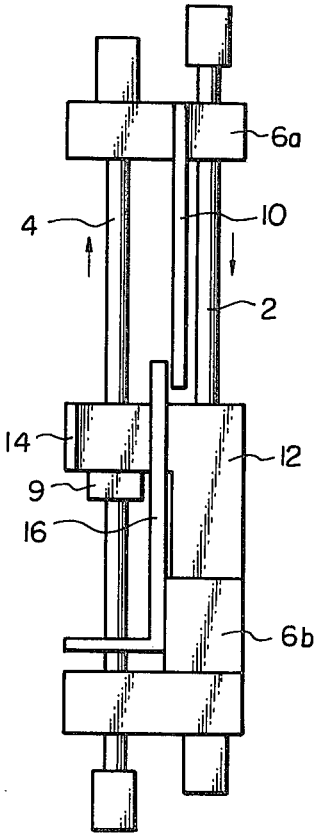

As the back rod 4 moves upwards, the upper holder 6*a*, the guide needle 10 and the upper end piece 4*a* move upwards while being urged by the torsion spring 8. The stopper 9 on the back rod 4 naturally moves upwards. As the opposite movements of the rods 2 and 4 continue, the stopper 9 comes in contact with the bottom face of the intermediate holder 12 as shown in FIG. 4E.

As the movements of the rods 2 and 4 continue, the lower holder 6*b* and the distributing guide 16 moves downwards. The stopper 9 on the upwardly moving back rod 4 thrusts up the intermediate holder 12 and the guide plate 14 now starts to move upwards. In other words, a relative vertical movement starts between the two elements 14 and 16 in order to distribute the leno warps TY1 and TY2 on both lateral sides of the ground warp GY. This relative movement between the elements 14 and 16 will hereinafter be referred to as "the second relative movement". During this second relative movement, the guide plate 14 moves upwards while the distributing guide 16 moves downwards, thereby stretching the tension spring 17 interposed between the two. Meanwhile, the guide needle 10 on the upper holder 6*a* goes on its upward movement.

Figure 4F:
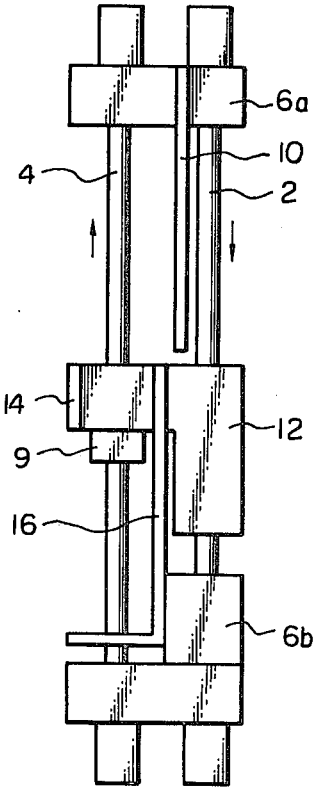

As hereinbefore described, the distance of the first relative movement should be equal to D in order to successfully carry out distribution of the leno warps TY1 and TY2 with respect to the ground warp GY. Then, it is clear that the distance of the second relative movement should be equal to D for the same purpose. That is, the second relative movement should terminate when the guide plate 14 has moved upwards from the position shown in FIG. 4E over a distance equal to D/2 and the distribution guide 16 has moved downwards over a distance D/2. The state of the device when the second relative movement is complete is shown in FIG. 4F, which is the same as the neutral state shown in FIG. 4A. The shed is closed in this state.

As the opposite movements of the two rods 2 and 4 further go on, the intermediate holder 12 is thrusted up by the stopper 9 and the guide plate 14 moves upwards. The lower holder **6*b* is thrusted up by the lower end piece 4*b* and the distributing guide 16 moves upwards over a same distance. That is, at this stage of the procedure, the two elements 14 and 16 move upwards while keeping the relative vertical position shown in FIG. 4F, which is equal to that in FIG. 4A. The guide needle 10** further goes on moving downwards.

Figure 4G:
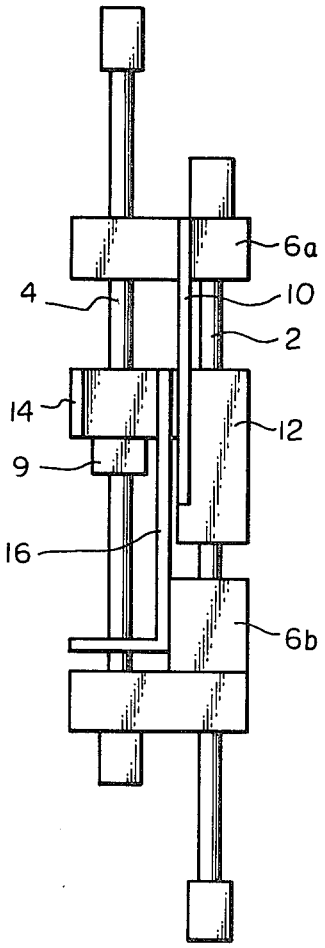

As the above-described vertical movements continue, the device is brought into a state shown in FIG. 4G. In this state, the ground warp GY controlled by the guide needle 10 is located in the lower sheet of the open shed whereas the leno warps TY1 and TY2 controlled by the guide plate 14 and the distributing guide 16 are located in the upper sheet of the open shed. Therefore, the inserted weft W is located over the ground warp GY and under the leno waprs TY1 and TY2.

The above-described vertical movements of the various elements are enumerated in Table 2.

TABLE 2

| | | | |
|---|---|---|---|
| Front rod 2 | | downward movement | |
| Back rod 4 | | upward movement | |
| Guide needle 10 | upward movement | upward movement | downward movement |
| Distributing guide 16 | downward movement | downward movement | upward movement |
| Guide plate 14 | downward movement | upward movement | upward movement |
| | FIG. 4D → 4E | FIG. 4E → 4F the second relative movement | FIG. 4F → 4G |

Selvage formation using the above-described device of the invention will hereinafter be explained in detail while referring to FIGS. 5A to 5E and 6A to 6E. In the illustration, the ground warp GY is omitted for simplification and the ground warp plane GYP is substituted therefor. Further, the thread guide holes **14*a* and 14*b* and the thread guide slots 16*a* and 16*b* are substituted for the guide plate 14 and the distributing guide 16**, respectively. Although two courses of lenos are concurrently formed in the illustrated embodiment, the following description is focussed upon the left course of leno in the illustration only for simplification.

As already described, distribution of the leno warps TY1 and TY2 with respect to the ground warp GY is carried out while utilizing the first and second relative movements of the guide plate 14 and the distributing guide 16. The details of the first and second relative movements of both elements 14 and 16 are summarized in Table 3.

TABLE 3

| | The first relative movement | The second relative movement |
|---|---|---|
| Guide plate 14 (Guide holes 14a, 14b) | downward movement | upward movement |
| Distrubuting guide 16 (Guide slots 16a, 16b) | upward movement | downward movement |

Figure 5A:
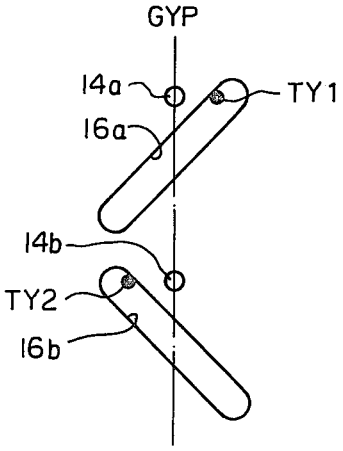
Figure 5B:
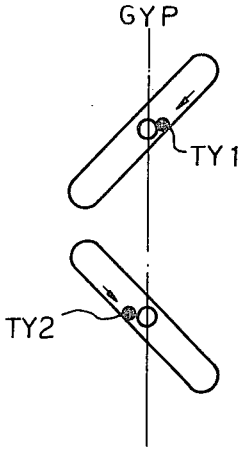
Figure 5C:
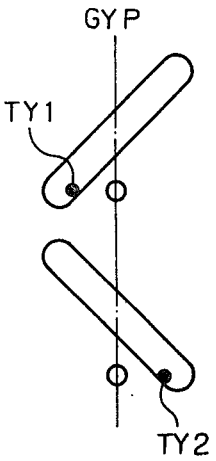
Figure 6A:
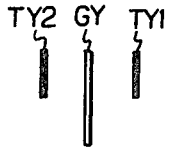
Figure 6B:
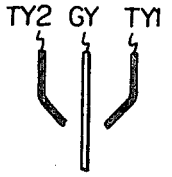
Figure 6C:
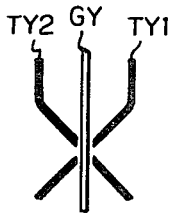

The first relative movement starts from the state shown in FIGS. 4A, 5A and 6A and terminates at the state shown in FIGS. 4C, 5C and 6C.

In the state shown in FIGS. 5A and 6A, one leno warp TY1 is located on the right side of the ground warp plane GYP whereas the other leno warp TY2 is located on the left side of the ground warp plane GYP. The ground warp GY assumes the highest position and the other leno warp TY2 assumes the lowest position.

As the first relative movement starts, the guide slots **16*a* and 16*b* move upwards and the guide holes 14*a* and 14*b* move downwards. Therefore, as seen in FIG. 5B, the one leno warp TY1 is thrusted outwards by the inner side edge of the upper guide slot 16*a* in order to approach the ground warp plane GYP from inner side whereas the other leno warp TY2 is thrusted inwards by the outer side edge of the lower guide slot 16*b* in order to approach the ground warp plane GYP from outer side. This procedure is shown in FIG. 6B**.

As the first relative movement continues, the one leno warp TY1 moves outwards beyond the ground warp plane GYP whereas the other leno warp TY2 moves inwards beyond the ground warp plane GYP. The original relative vertical position between the three warps remains unchanged at this stage of the procedure. Consequently, the two leno warps TY1 and TY2 cross under the ground warp GY and the one leno warp TY1 runs over the other leno warp TY2 at crossing.

The first relative movement, i.e. the first warp twisting operation, is completed in the state shown in FIGS. 5C and 6C. At weft insertion, the one leno warp TY1 assumes the highest position and the ground warp GY assumes the lowest position. Therefore, as shown n FIG. 6D, the inserted weft W is located over the ground warp GY and under the leno warps TY1 and TY2.

Figure 5D:
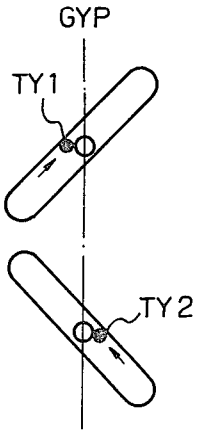
Figure 5E:
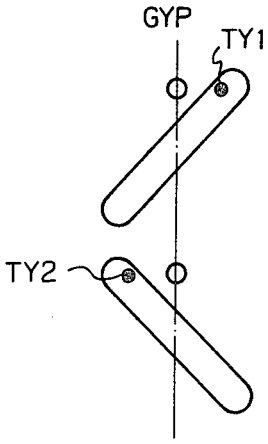
Figure 6D:
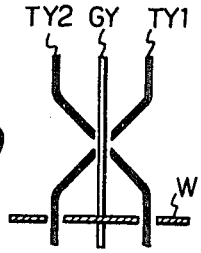
Figure 6E:
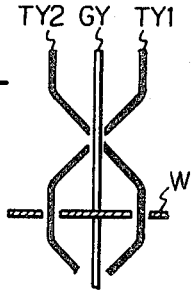
Figure 6F:
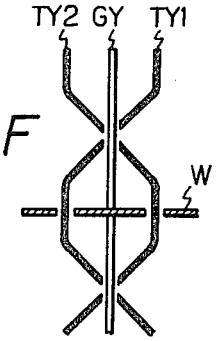

The second relative movement starts from the state shown in FIGS. 4E, 5C and 6D and terminates at the state shown in FIGS. 4F, 5E and 6F.

In the state shown in FIGS. 5C and 6D, the one leno warp TY1 is located on the left side of the ground warp plane GYP whereas the other leno warp TY2 is located on the right side of the ground warp plane GYP. The ground warp GY assumes the highest position and the other leno warp TY2 assumes the lowest position.

As the second relative movement starts, the guide slots **16*a* and 16*b* moves downwards and the guide holes 14*a* and 14*b* moves upwards. Therefore, as seen in FIG. 5D, the one leno warp TY1 is thrusted inwards by the outer side edge of the upper guide slots 16*a* in order to approach the ground warp plane GYP from outer side whereas the other leno warp TY2 is thrusted outwards by the inner side edge of the lower guide slot 16*b*** in order to approach the ground warp plane GYP from inner side.

As the second relative movement continues, the one leno warp TY1 moves inwards beyond the ground warp plane GYP whereas the other leno warp TY2 moves outwards beyond the ground warp plane GYP. The original relative vertical position between the three warps remains unchanged at this stage of the procedure. Consequently, the two leno warps TY1 and TY2 cross under the ground warp GY and the one leno warp TY1 runs over the other leno warp TY2 at crossing.

Figure 6G:
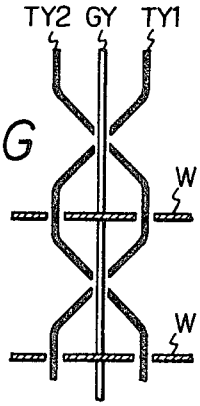

The second relative movement, i.e. the second warp twisting operation, is completed in the state shown in FIGS. 5E and 6F. At weft insertion, the one leno warp TY1 assumes the highest position and the ground warp GY assumes the lowest position. Therefore, as shown in FIG. 6G, the inserted weft W is located over the ground warp GY and under the leno warps TY1 and TY2.

Figure 7:
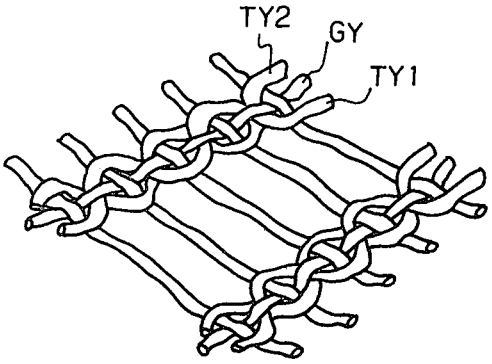
FIG. 7 is a fragmentary perspective view of a leno selvage formed by the device shown in FIG. 1.

By repetition of the above-described warp twisting operation, the leno warps are located alternately on different lateral sides of the ground warp and one weft insertion is carried out per one warp twisting operation in order to form a leno selvage shown in FIG. 7. In the construction of this leno selvage, the leno warps TY1 and TY2 always cross under the ground warp GY, the one leno warp TY1 always run over the other leno warp TY2 at crossing, the leno warps TY1 and TY2 are always located over the wefts W, and the ground warp GY is always located under the wefts W.

Figure 8:
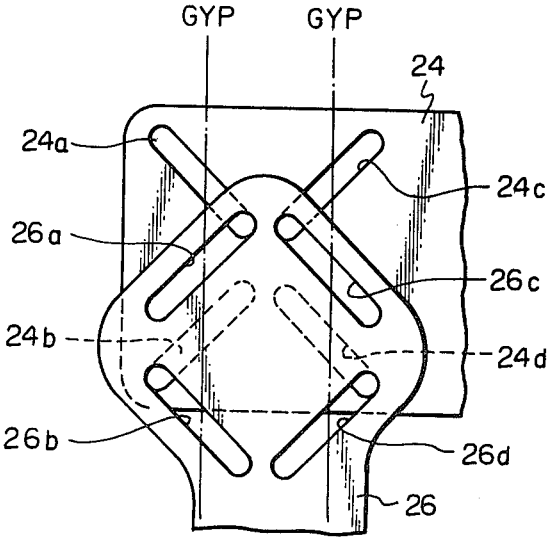
FIG. 8 is an explanatory front view of the thread distributing mechanism of the second embodiment of the selvage forming device in accordance with the present invention.

The second embodiment of the present invention is shown in FIG. 8, in which, as a substitute for the combination of the guide plate 14 with the distributing guide 16 in the first embodiment, a pair of first and second distributing guides 24 and 26 are used for distribution of the leno warps TY1 and TY2. The first distributing guide 24 is firmly held by the intermediate holder 12 and the second distributing guide 26 is firmly held by the lower holder 6b. The other construction and operation features of the device are substantially similar to that of the first embodiment. Therefore, the two distributing guides 24 and 26 carry out the first and second relative movements at the above-described timings and the distances of the movements are both equal to the vertical length of the gap D.

Two pairs of upper and lower thread guide slots 24a to 24d are formed in the first distributing guide 24. When seen from the front side of the device, the upper guide slots 24a and 24c start at positions on the outer sides of the respective ground warp planes and slope downwards and inwardly of the respective ground warp planes GYP. The lower guide slots 24b and 24d start at positions on the outer sides of the respective ground warp planes GYP and slopes upwards and inwardly of the respective ground warp planes GYP. The vertical distance between both ends of each thread guide slot 24a to 24d is equal to the distance D of the relative movement, i.e. the vertical length of the gap D.

Two pairs of upper and lower thread guide slots 26a to 26d are formed in the second distributing guide 26 also. When seen from the front side of the device, the upper guide slots 26a and 26c start at positions on the outer sides of the respective ground warp planes GYP and slopes upwards and inwardly of the respective ground warp planes GYP. The lower guide slots 26b and 26d start at positions on the outer sides of the respective ground warp planes GYP and slopes downwards in inwardly of the respective ground warp planes GYP. The vertical distance between both ends of each thread guide slot 26a to 26d is equal to the distance D of the relative movements, i.e. the vertical length of the gap D.

Operation of the above-described device will hereinafter be explained in detail while referring to FIGS. 9A to 9C. Although two courses of lenos are concurrently formed in the illustrated embodiment, the following description is limited to the left course of leno in the illustration only for simplification.

Figure 9A:
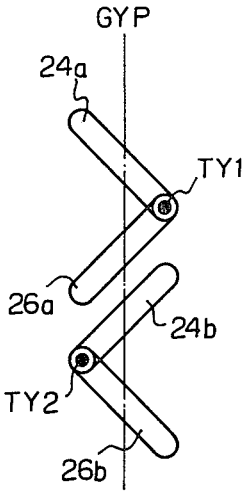
FIGS. 9A to 9B are simplified front views for showing operation of the thread distributing mechanism shown in FIG. 8.
Figure 9B:
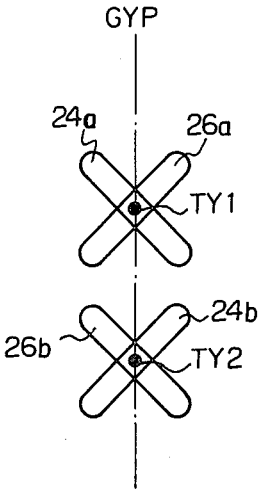

The state shown in FIG. 9A corresponds to that at the starting of the first relative movement or at the termination of the second relative movement. The arrangement is so designed that, when seen in the warp direction, the lower ends of the upper and lower guide slots 24a and 24b of the first distributing guide 24 are in alignment with the upper ends of the upper and lower guide slots 26a and 26b of the second distributing guide 26, in this state. The one leno warp TY1 is controlled by the mating point of the upper guide slots 24a and 26a and located on the inner side of the ground warp plane GYP. The other leno warp TY2 is controlled by the mating point of the lower guide slots 24b and 26b and located on the outer side of the ground warp plane GYP.

As the first distributing guide 24 moves downwards and the second distributing guide 26 moves upwards, the mating point of the upper guide slots 24a and 26a moves outwards so that the one leno warp TY1 approaches the ground warp place GYP from inner side. Concurrently with this, the mating point of the lower guide slots 24b and 26b moves inwards so that the other leno warp TY2 approaches the ground warp plane GYP from outer side. This procedure is known in FIG. 9B.

Figure 9C:
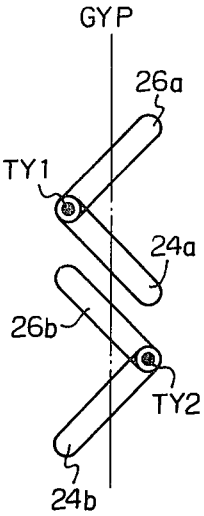

The first relative movement between the two distributing guides 24 and 26 lasts until the state shown in FIG. 9C. In this state, the one leno warp TY1 is located on the outer side of the ground warp plane GYP and the other leno warp TY2 is located on the inner side of the ground warp plane GYP. That is, the first distribution of the leno warp TY1 and TY2 with respect to the ground warp GY is completed. The device is so constructed that, in the state shown in FIG. 9C, the upper ends of the upper and lower guide slots 24a and 24b of the first distributing guide 24 are in alignment with the lower ends of the upper and lower guide slots 26a and 26b of the second distributing guide 26.

The state shown in FIG. 9C corresponds to that at the starting of the second relative movement.

As the first distributing guide 24 moves upwards and the second distributing guide 26 moves downwards, the mating point of the upper guide slots 24a and 26a moves inwards so that the one leno warp TY1 approaches the ground warp plane GYP from outer side, whereas the mating point of the lower guide slots 24b and 26b moves outwards so that the other leno warp TY2 approaches the ground warp plane GYP from inner side. This procedure is shown in FIG. 9B.

The two distributing guides 24 and 26 further go on the relative movement until the state shown in FIG. 9A. In this state, the one leno warp TY1 is located on the inner side of the ground warp plane GYP and the other leno warp TY2 is located on the outer side of the ground warp plane GYP. In other words, the second distribution of the leno warps TY1 and TY2 with respect to the ground warp GY is completed.

By repetition of the above-described procedure, the pair of warps TY1 and TY2 are located alternately on different lateral sides of the ground warp GY in order to form the leno selvage shown in FIG. 7.

Figure 10:
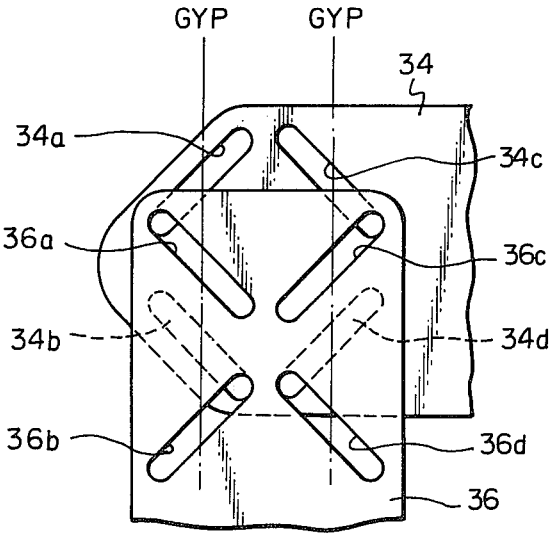
FIG. 10 is an explanatory front view of the thread distributing mechanism of the third embodiment of the selvage forming device in accordance with the present invention.

The third embodiment of the present invention is shown in FIG. 10. This device is different from the foregoing embodiment in the running directions of thread guide slots 34a to 34d and 36a to 36d. The other construction and operation features are substantially similar to that of the second embodiment.

Two pairs of upper and lower thread guide slots 34a to 34d are formed in the first distributing guide 34. When seen in the warp direction, the upper guide slots 34a and 34c start at positions on the outer sides of the respective ground warp planes GYP and slope upwards and inwardly of the respective ground warp planes GYP. The lower guide slots 34b and 34d start at positions on the outer sides on the respective ground warp planes GYP and slope downwards and inwardly of the respective ground warp planes GYP. The vertical distance between both ends of each thread guide slot 34*a* to 34*d* is equal to the distance D of the relative movements of the elements 34 and 36, i.e. the vertical length of the gap between the two holders 12 and 6*b*.

Operation of the above-described device will hereinafter be described in detail while referring to FIGS. 11A to 11C. Although two courses of lenos are concurrently formed in the illustrated embodiment, the following description is limited to the left course of leno in the illustration only for simplification.

Figure 11A:
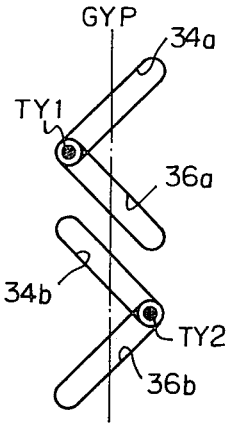
FIGS. 11A to 11C are simplified front views for showing operation of the thread distributing mechanism shown in FIG. 10.
Figure 11B:
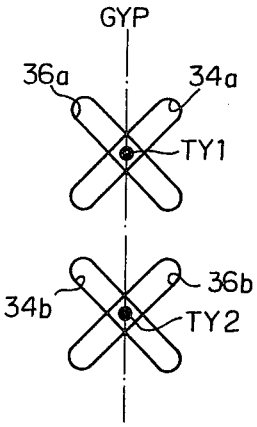

The state shown in FIG. 11A corresponds to that at the starting of the first relative movement or at the termination of the second relative movement. The arrangement is so designed that, when seen in the warp direction, the lower ends of the upper and lower guide slots 34*a* and 34*b* of the first distributing guide 34 are in alignment with the upper ends of the upper and lower guide slots 36*a* and 36*b* of the second distributing guide 36, in this state. The one leno warp TY1 is controlled by the mating point of the guide slots 34*a* and 36*a* and located on the outer side of the ground warp plane GYP. The other leno warp TY2 is controlled by the mating point of the lower guide slots 34*b* and 36*b* and located on the inner side of the ground warp plane GYP.

As the first distributing guide 34 moves downwards and the second distributing guide 36 moves upwards, the mating point of the upper guide slots 34*a* and 36*a* moves inwards so that the one leno warp TY1 approaches the ground warp plane GYP from outer side. Concurrently with this, the mating point of the lower guide slots 34*b* and 36*b* moves outwards so that the other leno warp TY2 approaches the ground warp plane GYP from inner side. This procedure is shown in FIG. 11B.

Figure 11C:
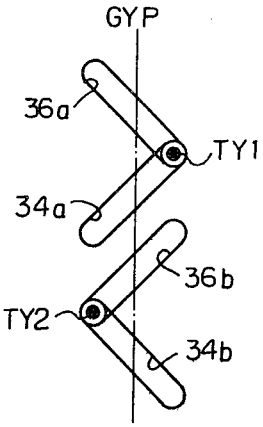

The first relative movement between the two distributing guides 34 and 36 lasts until the state shown in FIG. 11C. In this state, the one leno warp TY1 is located on the inner side of the ground warp plane GYP and the other leno warp TY2 is located on the outer side of the ground warp plane GYP. That is, the first distribution of the leno warps TY1 and TY2 with respect to the ground warp GY is completed. The device is so constructed that, in the state shown in FIG. 11C, the upper ends of the upper and lower guide slots 34*a* and 34*b* of the first distributing guide 34 are in alignment with the lower ends of the upper and lower guide slots 36*a* and 36*b* of the second distributing guide 36.

The state shown in FIG. 11C corresponds to that at the starting of the second relative movement between the two guides 34 and 36.

As the first distributing guide 34 moves upwards and the second distributing guide 36 moves downwards, the mating point of the upper guide slots 34*a* and 36*a* moves outwards so that the one leno warp TY1 approaches the ground warp plane GYP from inner side, whereas the mating point of the lower guide slots 34*b* and 36*b* moves inwards so that the other leno warp TY2 approaches the ground warp plane GYP from outer side. This procedure is shown in FIG. 11B.

The two distributing guides 34 and 36 further continue the relative movement until the state shown in FIG. 11A. In this state, the one leno warp TY1 is located on the outer side of the ground warp plane GYP and the other leno warp TY2 is located on the inner side of the ground warp plane GYP. In other words, the second distribution of the leno warps TY1 and TY2 with respect to the ground warp GY is completed.

By repetition of the above-described procedure, the pair of leno warps TY1 and TY2 are located alternately on different lateral sides of the ground warp GY in order to form the leno selvage shown in FIG. 7.

In the case of the second and third embodiments, each leno warp is controlled by the mating point of a pair of cooperating slant thread guide slots during its lateral movement. This control well restrains undesirable whipping of the leno warps, thereby assuring greatly stabilized distribution of the leno warps with respect to the ground warp.

In the case of the first to third embodiments of the present invention, a course of leno is made up of three sets of mutually twisting warps, i.e. the ground warp and a pair of leno warps located alternately on different lateral sides of ground warp. However, the present invention is applicable to cases in which a course of leno is made up of a pair of warps only, i.e. a ground warp and a leno warp located alternately on different lateral sides of the ground warp.

Figure 12:
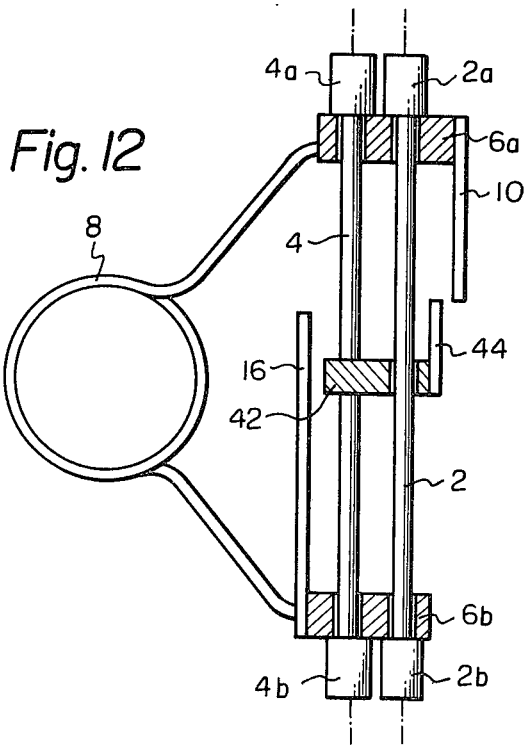
FIG. 12 is a side view, partly in section, of the fourth embodiment of the selvage forming device in accordance with the present invention.
Figure 13:
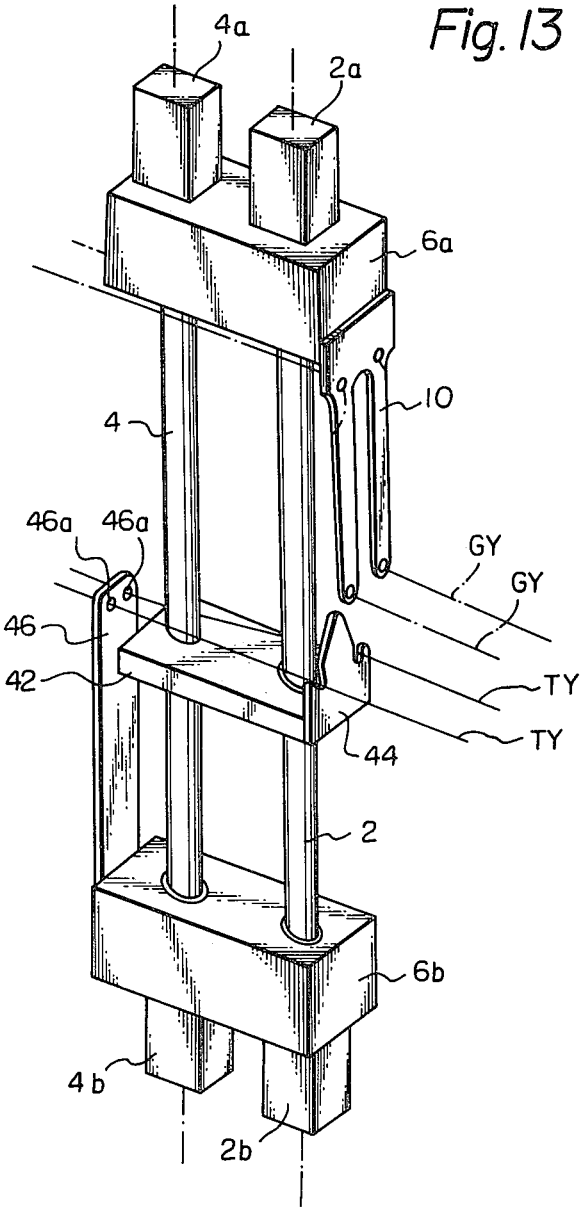
FIG. 13 is a perspective view of the device shown in FIG. 12.

The fourth embodiment of the present invention of the abovedescribed type is shown in FIGS. 12 to 14, in which elements substantially similar in construction and operation to those used in the foregoing embodiments are designated with common reference symbols. The device of this embodiment is adapted for concurrently forming two courses of lenos, each being made up of a ground warp GY and a leno warp TY.

A catcher holder 42 (hereinafter referred to as "an intermediate holder") is fixed about the middle of the back rod 4 and idlly inserted over the front rod 2. This intermediate holder 42 is provided on the front face with a catcher plate 44 shown in FIG. 14. The catcher plate 44 has a center head 44*a* tapering upwards and a pair of thread guide notches 44*b* arranged on both lower sides of the center head 48*a*, one guide notch 44*b* being for one course of leno.

A guide plate holder 6*b* (hereinafter referred to as "a lower holder") is provided on the back face with an upwardly extending guide plate 46. This guide plate 46 has a pair of laterally spaced thread guide holes 46*a* formed in the top portion thereof.

Relationship in position between the cooperating elements 10, 4 and 46 in the neutral state is shown in FIG. 14. In this state, each lower guide hole 10*b* of the guide needle 10 is located at a position which is somewhat above the center of the catcher plate 44, on the outer side of the corresponding guide hole 46*a* of the guide plate 46, and on the inner side of the corresponding guide notch 44*b* of the catcher plate 44. The vertical position of each guide hole 46*a* of the guide plate 46 is almost similar to that of the corresponding guide notch 44*b* of the catcher plate 44.

Operation of the above-described device is as follows.

As the rods 2 and 4 are operatively linked to the cooperating harnesses for plain weave, then as the front rod 2 moves upwards over a certain distance, the back rod 4 moves downwards over a similar distance. The catch plate 14 follows the above-described downward movement of the back rod 4 since the plate 14 is in a fixed relationship with the back rod 4 via the intermediate holder 42. The upper holder 6*a* is thrusted by the upper end piece 4*a* fixed to the back rod 4 and the guide needle 10 fixed thereto follows this downward movement also. Following the upward movement of the front rod 2, the lower holder 6*b* is thrusted up by the lower end piece fixed to the front rod 2 so that the guide plate 46 should move upwards over an equal distance.

As the front rod 2 moves downwards, the back rod 4 accordingly moves upwards. Following this upward movement of the back rod 41, the catcher plate 44 fixed to the back rod 4 via the intermediate holder 42 moves upwards over an equal distance. As the lower holder **6*b* is thrusted up by the lower end piece 4*b* fixed to the back rod 4, the guide plate 46 held by the lower holder 6*b* moves upwards over an equal distance. Concurrently with this procedure, the upper holder 6*a* is thrusted down by the upper end piece 2*a* fixed to the front rod 2 and, consequently, the guide needle 10 held by the upper holder 6*a*** moves downwards over an equal distance.

The above-described procedure is summarized in Table 4.

TABLE 4

| | | |
|---|---|---|
| Front rod 2 | upward movement | downward movement |
| Back rod 4 | downward movement | upward movement |
| Guide needle 10 | downward movement | downward movement |
| Catcher plate 14 | downward movement | upward movement |
| Guide plate 16 | upward movement | upward movement |

From this table, the dynamic relationship between the cooperating elements 10, 14 and 16 is summarized as follows;

As the front rod 2 moves upwards or downwards over a certain distance, (a) the guide needle 10 always moves downwards over an equal distance, (b) the catcher plate 44 moves downwards or upwards over an equal distance, and (c) the guide plate 46 always moves upwards over an equal distance.

Formation of leno selvage on the device of the above-described construction will hereinafter described in detail.

Each leno warp TY is controlled by the thread guide hole **46*a* of the guide plate 46 and by the catcher plate 44 and each ground warp GY is controlled by the thread guide hole 10*b* of the guide needle 10**.

Although two courses of leno are concurrently formed on the device of this embodiment, the following description is limited to the left course of leno only for simplification.

Figure 15B:
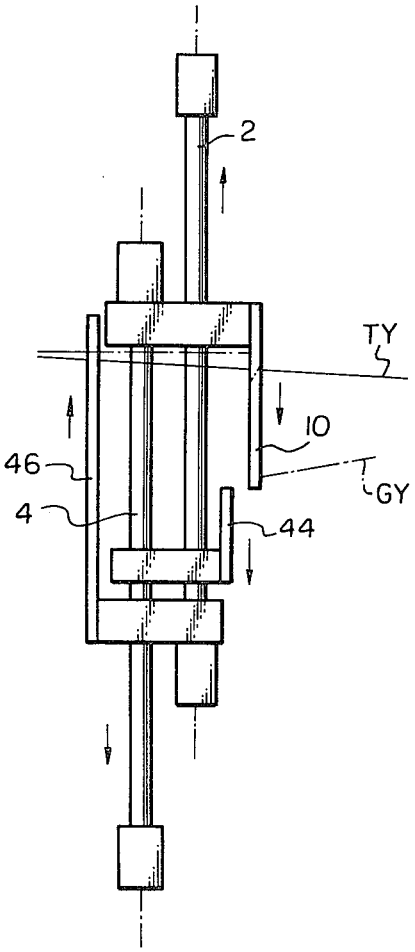
Figure 16A:
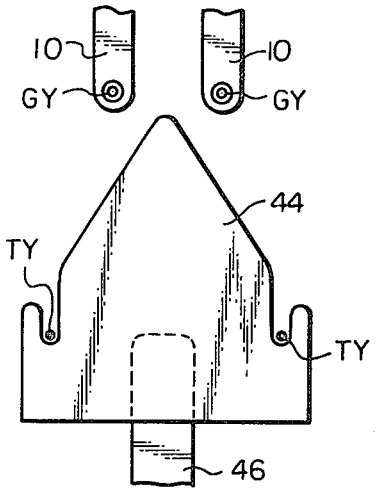
Figure 17A:
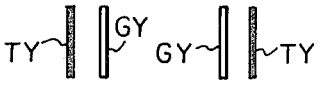
Figure 17B:
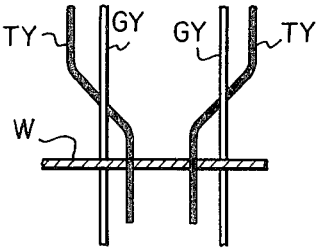
Figure 17C:
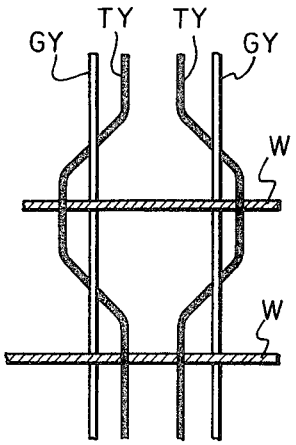
Figure 18:
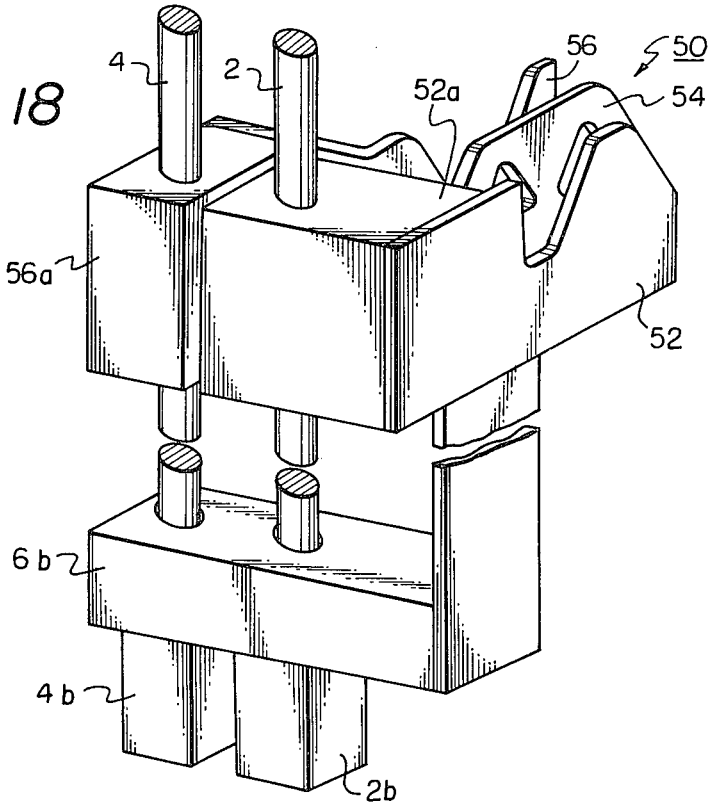
FIG. 18 is a fragmentary perspective view of the fifth embodiment of the selvage forming device in accordance with the present invention.

The neutral state of the device and the warps are shown in FIGS. 15A, 16A and 17A, in which the shed is closed. The ground warp GY runs through the guide hole **10*b* of the guide needle 10 and the leno warp TY is placed under control by the guide notch 44*b* of the catcher plate 44. The guide notch 44*b* is located on the outer side of the guide hole 10*b* of the guide needle 10. Therefore, the leno warp TY is located on the outer side of the associated ground warp GY as shown in FIG. 17**A.

In the first shedding motion, the front rod 2 moves upwards and the back rod 4 moves downwards as shown in FIG. 15B. Following these movements, the guide needle 10 moves downwards, the catcher plate 44 moves downwards and the guide plate 46 moves upwards.

Figure 16B:
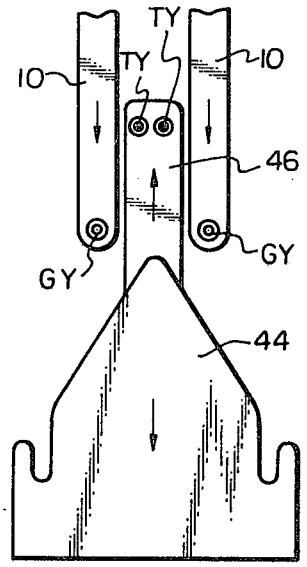

As a result of such a relative movement, the leno warp TY moves upwards out of the control by the guide notch **44*b* of the catcher plate 44 and placed under control by the guide hole 46*b* of the guide plate 46 only as shown in FIG. 16B. Since the guide hole 46*b* of the guide plate 46 is located on the inner side of the guide hole 10*b* of the guide needle 10, the leno warp TY in this state is located on the inner side of the ground warp GY. It should be noted that the leno warp TY moves from outer side to inner side of the ground warp GP while passing the under side of the ground warp GP as shown in FIG. 17**B. The inserted weft W is thus located over the ground warp GY and under the leno warp TY.

Figure 15C:
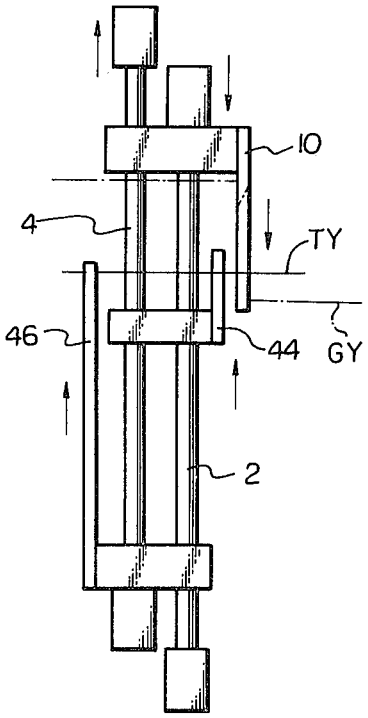
Figure 16C:
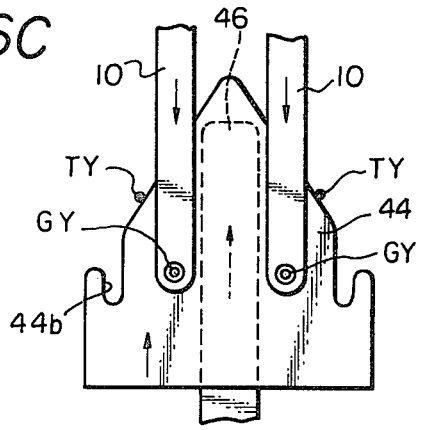

In the second shedding motion, the front rod 2 moves downwards and the back rod 4 moves upwards. As is clear from Table 4, the guide needle 10 accordingly moves downwards, the catcher plate 44 moves upwards and the guide plate 46 moves upwards as shown in FIG. 15C. Following this upward movement of the catcher plate 44, the leno warp TY caught by the guide plate 46 comes in contact with the sloping shoulder of the center head **44*a* of the catcher plate 44 and is gradually thrusted outwards as shown in FIG. 16C. After coming to the outer side of the ground warp GY caught by the guide needle 10, the leno warp TY falls into and is again placed under control by the guide notch 44*b* of of the catcher plate 44. The device should be so constructed that the leno warp TY is located above the ground warp GY after the leno warp TY has been placed on the outer side of the ground warp GY. Thus, the leno warp TY moves from the inner side to the outer side of the ground warp GY while passing the under side of the ground warp GY. The inserted weft W is then located above the ground warp GY and under the leno warp TY as shown in FIG. 17**C.

By cyclic repetition of the above-described procedure, a selvage having two courses of leno is formed on the device of the present invention.

The fifth embodiment of the present invention is shown in FIGS. 18, 19A to 19C and 20. In the case of this embodiment, a guide assembly 50 made up of front, middle and back guide plates 52, 54 and 56 is substituted for the combination of the catcher plate 44 with the guide plate 46 used in the fourth embodiment.

The three guide plates 52, 54 and 56 are spacedly arranged in parallel to each other at a substantially equal vertical position as hereinafter explained in more detail. In the illustration shown in FIG. 18, spaces between the neighbouring guide plates are illustrated as being far larger than the actual ones for easier understanding of the construction.

Figure 19A:
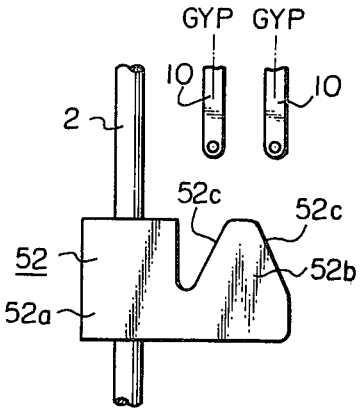
FIGS. 19A to 19C are front views of elements making up the thread distributing mechanism of the device shown in FIG. 18.

As shown in FIG. 19A, the front guide plate 52 is fixed to the front rod 2 via a holding section **52*a* and has an upwardly tapering guide section 52*b* defined by two sloping shoulders 52*c*. When seen in the warp direction, each shoulder 52*c*** starts from inner side of the ground warp plane GYP and extends downwards to outer side of the ground warp plane GYP.

Figure 19B:
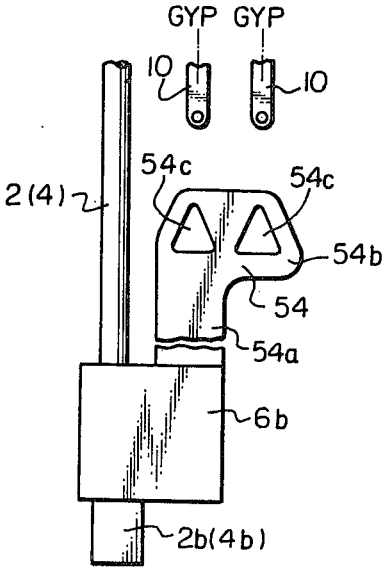

As shown in FIG. 19B, the middle guide plate 54 is fixed to the lower holder **6*b* via a holding section 54*a* and has a trapezoid guide section 54*b* formed atop the holding section 54*a*. The guide section 54*b* is provided with a pair of triangular apertures 54*c*. The top apex of each aperture 54*c*** is located in the ground warp plane GYP and the outer side apex is located on the outer side of the ground warp plane GYP.

Figure 19C:
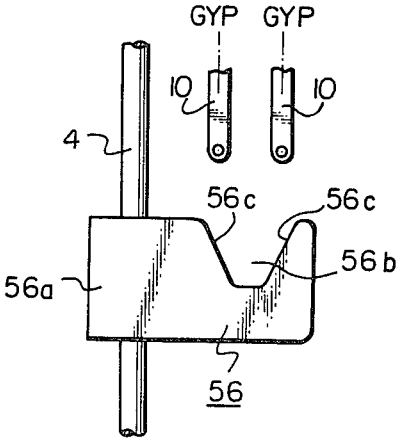

As shown in FIG. 19C, the back guide plate 56 is fixed to the back rod 4 via a holding section **56*a* and has a guide notch 56*b* defined by a pair of sloping shoulders 56*c*. When seen in the warp direction, each shoulder 56*c*** starts from outer side of the ground warp plane GYP and extends downwards to inner side of the ground warp plane GYP.

Figure 20:
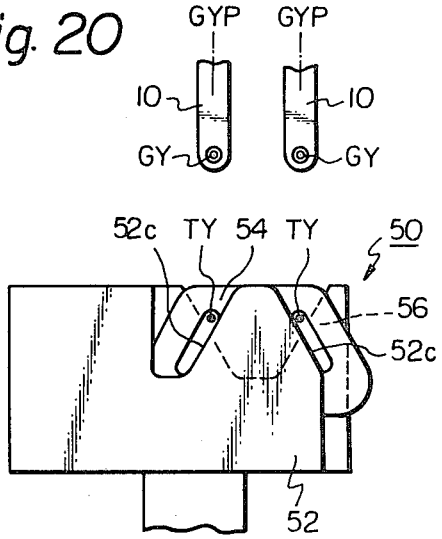
FIG. 20 is an explanatory front view of the thread distributing mechanism in the assembled state.

Relationship in position of the cooperating elements 52, 54 and 56 in the neutral state of the device is shown in FIG. 20, in which the warp shed is closed. In this state, the guide plates 52, 54 and 56 are located below the guide holes 10*b* of the guide needle 10 and their upper faces are substantially flush with each other. When seen in the warp direction in this state further, the outer edge of each aperture 54*c* of the middle guide plate 54 is located on the outer side of the associated sloping shoulder 52*c* of the front guide plate 52. The top apex portion of each aperture 54*c* of the middle guide plate 54 does not overlap the solid sections of the other guide plates 52 and 56.

Operation of the device of the above-described construction is as follows.

As the front rod 2 moves upwards over a certain distance, the back rod 4 moves downwards over an equal distance just like in the foregoing embodiments.

Following the downward movement of the back rod 4, the back guide plate 56 fixed thereto moves downwards over an equal distance also. As the upper holder 6*a* is thrusted down by the upper end piece 4*a* fixed to the back rod 4, the guide needle 10 held thereby moves downwards over an equal distance.

As the front rod 2 moves upwards, the lower end piece 2*b* fixed thereto thrusts up the lower holder 6*b* and the middle and front guide plates 54 and 52 both move upwards over equal distances.

As the front rod 2 moves upwards over a certain distance, the back rod 4 moves downwards over an equal distance. Following the upward movement of the back rod 4, the back guide plate 56 moves upwards over an equal distance. As the lower holder 6*b* is thrusted up by the lower end piece 4*b* comovable with the back rod 4, the middle guide plate 54 held thereby moves upwards over an equal distance. Following the downward movement of the front rod 2, the upper holder 6*a* is thrusted down by the upper end piece 2*a* comovable with the front rod 2 and the guide needle 10 and the front guide plate 52 both move downwards over equal distances.

The above-described procedure is summarized in Table 5.

TABLE 5

| | | |
|---|---|---|
| Front rod 2 | upward movement | downward movement |
| Back rod 4 | downward movement | upward movement |
| Guide needle 10 | downward movement | downward movement |
| Front guide plate 52 | upward movement | downward movement |
| Middle guide plate 54 | upward movement | upward movement |
| Back guide plate 56 | downward movement | upward movement |

As is clear from this table, the relative movement of the cooperating three guide plates 52, 54 and 56 is summarized as follows;

As the front rod 2 moves upwards or downwards over a certain distance, (a) the guide needle 10 always move downwards over an equal distance, (b) the front guide plate 52 moves upwards or downwards over an equal distance, (c) the middle guide plate 54 always moves upwards over an equal distance, and (d) the back guide plate 56 moves downwards or upwards over an equal distace.

Formation of the leno selvage on the above-described device will hereinafter be explained in detail in reference to FIGS. 20, 21A and 21B. Each leno warp TY runs through the aperture 54*c* of the middle guide plate 54 and the ground warp GY is controlled by the guide needle 10.

In the neutral state of the device shown in FIG. 20, the warp shed is closed. The leno warp TY is located near the top apex of the aperture 54*c* of the middle guide plate 54 and controlled thereby. In this state, the leno warp TY is located substantially in the ground warp plane GYP.

Figure 21A:
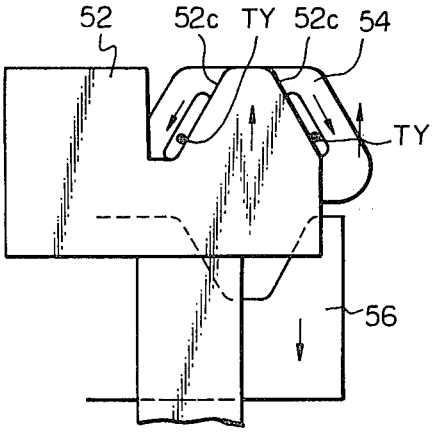
FIGS. 21A and 21B are explanatory front views for showing operation of the thread distributing mechanism shown in FIG. 18.

In the state shown in FIG. 21A, the front rod 2 is moving upwards and the back rod 4 is moving downwards during the motion. As is clear from Table 5, the guide needle 10 accordingly moves downwards, the front and middle guide plates 52 and 54 both move upwards and the back guide plate 56 moves downwards. As a result of this relative movement, the leno warp TY remains in engagement with the front and middle guide plates 52 and 54 only and the back guide plate 56 runs out of this engagement. Therefore, the leno warp TY is thrusted outwards by the sloping shoulder 52*c* of the front guide plate 52 so as to move outwards in the aperture 54*c* of the middle guide plate 54. When the shedding motion is complete, the leno warp TY is brought to the outer end of the sloping shoulder 52*c* of the front guide plate 52, i.e. a position on the outer side of the ground warp GY controlled by the guide needle 10.

Figure 21B:
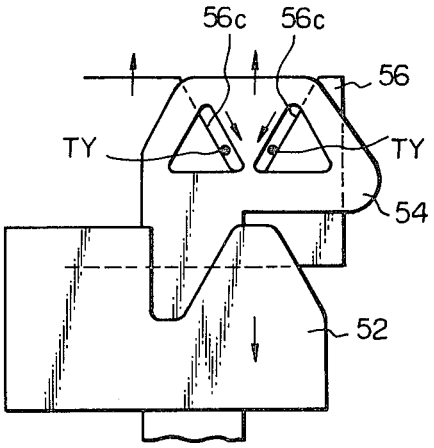

In the state shown in FIG. 21B, the front rod 2 is moving downwards and the back rod 4 is moving upwards during the next shedding motion. As is clear from Table 5, the guide needle 10 accordingly moves downwards, the front guide plate 52 moves downwards and the middle and back guide plates 54 and 56 both move upwards. As a result of this relative movement, the leno warp TY remains in engagement with the middle and back guide plates 54 and 56 only and the front guide plate 52 runs out of this engagement. Therefore, the leno warp TY is thrusted inwards by the sloping shoulder 56*c* of the back guide plate 56 so as to move inwards in the aperture 54*c* of the middle guide plate 54. When the shedding motion is complete, the leno warp TY is brought to the outer end of the sloping shoulder 56*c* of the back guide plate 56, i.e. a position on the inner side of the ground warp GY controlled by the guide needle 10.

By repetition of the above-described procedure, the leno warp TY is located alternately on different sides of the ground warp GY in order to form a selvage made up of two courses of leno.

In the case of this fifth embodiment, each leno warp TY is controlled, during its lateral movement, by a narrow slanted slot defined by the sloping shoulder 52*c* of the front guide plate 52 and the corresponding outer edge of the aperture 54*c* of the middle guide plate 54 (see FIG. 21A), or by a like narrow slanted slot defined by the sloping shoulder 56*c* of the back guide plate 56 and the same edge of the apeture 54*c* of the middle guide plate 54 (see FIG. 21B). Thus, undesirable whipping of the leno warps TY during the distribution can effectively shunned.

In FIGS. 16C, 21A and 21B, the leno warp TY moves in the above-described narrow slanted slots, since leno warp TY is located in the upper sheet of the open shed.

Although vertical movements of the pair of vertical rods are related to those of different heald frames in the above-described embodiments, however, a pair of levers can be used as a substitute for the heald frames. In this case, the vertical rods are coupled to one ends of different levers which swing alternately into different vertical directions once in every loom cycle.

Following advantages result from employment of the present invention in the construction of a leno selvage forming device.

(i) Since the invention employs the so-called MAV system in which leno warps are twisted about associated grand warps at every pick, very strong selvages can be obtained regardless of the very compact and simple construction of the device.

(ii) Mechanical elements are required to move simply in the vertical direction only while utilizing the regular shedding motion or like lever motion. Therefore, the number of the movable elements is very small, thereby greatly enhancing durability of the device.

(iii) As the leno warps are forced to move along slanted edges of the mechanical elements, no concentrated abrasion of the element surfaces by contact with the thread occurs. This greatly elongates lives of the mechanical elements. In addition, as the contact surfaces of the mechanical elements with the threads can be maintained smooth for a long period, fluffing and breakage of the threads can be both prevented remarkably.

(iv) As distribution of leno warps is carried out via vertical movements of the mechanical elements only, the related mechanical elements are required to perform very simple and trouble free movements only. Consequently, operation of the device can well follow high speed running of weaving looms. It is also relatively easy to increase the number of leno courses in a single selvage.

(v) Parts of the device are very easily visible and accessible from outside, thereby assuring easy detection of operational accident and simplified maintenance of the device.

(vi) Since no forced bending is applied to threads during the distribution, undesirable damage on the threads can be well avioded.

(vii) When threads are controlled by narrow slanted slots formed by mechanical elements, undesirable whipping of the threads during the distribution can be successfully prevented.

I claim:

1. An improved selvage forming device comprising a pair of spacedly arranged parallel and vertical rods, means for driving said vertical rods to opposite vertical movement in such a manner that, when one rod moves upwards or downwards over a prescribed distance, the other rod concurrently moves downwards or upwards over an equal distance, a pair of upper and lower holders idly inserted over said pair of vertical rods, means for resiliently urging said upper and lower holders on a movement away from each other in such a manner that said upper holder follows a downward movement of either said vertical rod over an equal distance whereas said lower holder follows an upward movement of either said vertical rod over an equal distance, a stopper fixed about the middle of one said vertical rod, an intermediate holder idly inserted over said pair of vertical rods at a position above said stopper in such an arrangement that, in the completely closed state of the shed, said intermediate holder rests on said stopper and a prescribed length of gap for a relative vertical movement is left between the lowest face thereof and the highest face of said lower holder, a tension spring interposed between said intermediate and lower holders, a downwardly extending guide needle held by said upper holder and provided with at least one thread guide hole for a ground warp in a ground warp plane, and means for distributing at least one leno warp alternately onto the different lateral sides of said ground warp once in every pick in accordance with said relative vertical movement between said intermediate and lower holders.

2. An improved selvage forming device as claimed in claim 1 in which said driving means include different heald frames for plain weave.

3. An improved selvage forming device as claimed in claim 1 in which said driving means include a pair of swing levers which alternately swing into different vertical directions once in one cycle of a loom.

4. An improved selvage forming device as claimed in claim 1 in which said resiliently urging means include a torsion spring connected at both ends to said upper and lower holders, a pair of enlarged upper end pieces fixed atop said pair of vertical rods at a vertical position above said upper holder, and a pair of enlarged lower end pieces fixed to the bottom ends of said pair of vertical rods at a vertical position below said lower holder.

5. An improved selvage forming device as claimed in claim 1 in which said distributing means include a laterally extending guide plate fixed to said intermediate holder and provided with at least one thread guide hole for said at least one leno warp, said at least one thread guide hole being located in said ground warp plane, an upwardly extending distributing guide fixed to said lower holder and provided with at least one laterally slanted thread guide slot for said at least one leno warp, one end of said thread guide slot being located on the outer side of said ground warp plane whereas the other end of said thread guide slot being located on the inner side of said ground warp plane.

6. An improved selvage forming device as claimed in claim 5 in which one course of leno is made up of one ground warp and one leno warp, said guide needle is provided, for said one course of leno, with one said thread guide hole for said one ground warp, said guide plate is provided, for said one course of leno, with one said thread guide hole, for said one leno warp, and said distributing guide is provided, for said one course of leno, with one said thread guide slot for said one leno warps.

7. An improved selvage forming device as claimed in claim 5 in which one course of leno is made up of one ground warp and two leno warps, said guide needle is provided, for said one course of leno, with one said thread guide hole for said one ground warp, said guide plate is provided, for said one course of leno, with a pair of upper and lower said thread guide holes for said respective leno warps, said distributing guide is provided, for said one course of leno, with a pair of upper and lower said thread guide slots for said respective leno warps, and the slanting directions of said thread guide slots are opposite to each other.

8. An improved selvage forming device as claimed in claim 6 or 7 in which the vertical distance between both ends of each said thread guide slot is equal to the length of said gap between said intermediate and lower holders.

9. An improved selvage forming device as claimed in claim 6 or 7 in which, when the shed is completely closed, said thread guide hole of said guide needle is located above each said thread guide hole of said guide plate and associated said thread guide slot of said distributing guide, and each said thread guide hole of said guide plate is at a substantially same level with the upper end of associated said thread guide slot.

10. An improved selvage forming device as claimed in claim 1 in which said distributing means include a laterally extending first distributing guide fixed to said intermediate holder and provided with at least one laterally slanted first thread guide slot for said at least one leno warp, one end of said first thread guide slot being located on the outer side of said ground warp whereas the other end of said first thread guide slot being located on the inner side of said group warp plane, and an upwardly extending second distributing guide fixed to said lower holder and provided with at least one laterally slanted second thread guide slot for said at least one leno warp, one end of said second thread guide slot being located on the outer side of said ground warp plane whereas the other end of said second thread guide slot being located on the inner side of said ground warp plane, and the slanting directions of said first and second thread guide slots being opposite to each other.

11. An improved selvage forming device as claimed in claim 10 in which one course of leno is made up of one ground warp and one leno warp, said guide needle is provided, for said one course of leno, with one said thread guide for said one ground warp, said first distributing guide is provided, for said one course of leno, with one said first thread guide slot for said one leno warp, and said second distributing guide is provided, for said one course of leno, with one said second thread guide slot for said one leno warp.

12. An improved selvage forming device as claimed in claim 10 in which one course of leno is made up of one ground warp and two leno warps, said guide needle is provided, for said one course of leno, with one said thread guide hole for said one ground warp, said first distributing guide is provided, for said one course of leno, with a pair of upper and lower said first thread guide slots for said respective leno warps which are opposite in slanting direction to each other, and said second distributing guide is provided, for said one course of leno, with a pair of upper and lower said second thread guide slots for said respective leno warps which are opposite in slanting direction to each other.

13. An improved selvage forming device as claimed in claim 11 or 12 in which the vertical distance between both ends of each said thread guide slot is equal to the length of said gap between said intermediate and lower holders.

14. An improved selvage forming device as claimed in claim 11 or 12 in which, when the shed is completely closed, said thread guide hole of said guide needle is located above each said thread guide slot of each said distributing guide, and the lower end of each said first thread guide slot is at a substantially same level with the upper end of associated said second thread guide slot.

15. An improved selvage forming device comprising a pair of spacedly arranged parallel and vertical rods, means for driving said vertical rods to opposite vertical movement in such a manner that, when one rod moves upwards or downwards over a prescribed distance, the other rod concurrently moves downwards or upwards over an equal distance, a pair of upper and lower holders idly inserted over said pair of vertical rods, means for resiliently urging said upper and lower holders on a movement away from each other in such a manner that said upper holder follows a downward movement of either said vertical rod over an equal distance whereas said lower holder follows an upward movement of either said vertical rod over an equal distance, an intermediate holder fixed about the middle of one said vertical rod, a downwardly extending guide needle held by said upper holder and provided, for one course of leno, with one thread guide hole for a ground warp in the group warp plane, and means for distributing one leno warp alternately onto the different lateral sides of said ground warp one in every pick in accordance with a relative vertical movement between said intermediate and lower holders.

16. An improved selvage forming device as claimed in claim 15 in which said driving means include different heald frames for plain weave.

17. An improved selvage forming device as claimed in claim 15 in which said driving means include a pair of swing levers which alternately swing into different vertical directions once in one cycle of a loom.

18. An improved selvage forming device as claimed in claim 15 in which said resiliently urging means include a torsion spring connected at both ends to said upper and lower holders, a pair of enlarged upper end pieces fixed atop said pair of vertical rods at a vertical position above said upper holder, and a pair of enlarged lower end pieces fixed to the bottom ends of said pair of vertical rods at a vertical position below said lower holder.

19. An improved selvage forming device as claimed in claim 15 in which said distributing means include a catcher plate fixed to said intermediate plate and provided, for said one course of leno, with a thread guide notch for said one leno warp and a slanted edge sloping down into said thread guide notch, the upper end of said slant edge being located on the inner side of said ground warp plane, and said thread guide notch being located on the outer side of said ground warp plane, and an upwardly extending guide plate fixed to said lower holder and provided, for said one course of leno, with a thread guide hole located on the inner side of said ground warp plane.

20. An improved selvage forming device as claimed in claim 19 in which, when the shed is completely closed, said thread guide hole of said guide needle is located above said thread guide notch of said catcher plate and said thread guide hole of said guide plate which are at a substantially same level.

21. An improved selvage forming device as claimed in claim 15 in which said distributing means include a laterally extending first guide plate fixed to the other said vertical rod and provided, for said one course of leno, with a sloping shoulder, the upper end of said sloping shoulder being located on the inner side of said ground warp plane, and the lower end of said sloping shoulder being located on the outer side of said ground warp plane, an upwardly extending second guide plate held by said lower holder and provided, for said one course of leno, with a triangular aperture, the top apex of said aperture being located in said ground warp plane, and the outer side apex of same being located on the outer side of said ground warp plane, and a laterally extending third guide plate held by said intermediate holder and provided, for said one course of leno, with a sloping shoulder, the upper end of said sloping shoulder being located on the outer side of said ground warp plane, and the lower end of said sloping shoulder being located on inner side of said ground warp plane.

22. An improved selvage forming device as claimed in claim 21 in which, when the shed is completely closed, said thread guide hole of said guide needle is located above said upper ends of said sloping shoulders of said first and third guide plates which are at a substantially same level.

* * * * *